US009205541B2

(12) United States Patent
Lefavour et al.

(10) Patent No.: US 9,205,541 B2
(45) Date of Patent: Dec. 8, 2015

(54) BUCKET TRUCK INTENSIFIER

(71) Applicant: Hubbell Incorporated, Shelton, CT (US)

(72) Inventors: John D. Lefavour, Litchfield, NH (US); Thomas R. Faucher, Manchester, NH (US); William L. Benedict, Littleton, NH (US); Henry A. Maxwell, Pembroke, NH (US)

(73) Assignee: Hubbell Incorporated, Shelton, CT (US)

( * ) Notice: Subject to any disclaimer, the term of this patent is extended or adjusted under 35 U.S.C. 154(b) by 234 days.

(21) Appl. No.: 13/925,574

(22) Filed: Jun. 24, 2013

(65) Prior Publication Data

US 2013/0340223 A1 Dec. 26, 2013

Related U.S. Application Data

(60) Provisional application No. 61/663,825, filed on Jun. 25, 2012.

(51) Int. Cl.

| | |
|---|---|
| ***B21J 15/34*** | (2006.01) |
| ***B25B 21/00*** | (2006.01) |
| ***B25B 27/10*** | (2006.01) |

(52) U.S. Cl.

CPC ..... *B25B 21/001* (2013.01); *B25B 27/10* (2013.01); *Y10T 29/53726* (2015.01)

(58) Field of Classification Search

CPC .. B25B 21/001; B25B 27/10; Y10T 29/53726
See application file for complete search history.

(56) References Cited

U.S. PATENT DOCUMENTS

| | | | | | |
|---|---|---|---|---|---|
| 3,889,340 | A | * | 6/1975 | Dixon, Jr. | 72/416 |
| 3,898,805 | A | * | 8/1975 | Good, Jr. | 60/325 |
| 4,342,216 | A | | 8/1982 | Gregory | |
| 4,366,673 | A | | 1/1983 | Lapp | |
| 4,903,522 | A | * | 2/1990 | Miller | 72/453.17 |
| 5,465,755 | A | * | 11/1995 | Lapp | 72/453.16 |
| 5,653,368 | A | * | 8/1997 | Miles et al. | 72/18.9 |
| 5,979,215 | A | | 11/1999 | LeFavour | |
| 6,148,507 | A | | 11/2000 | Swanson | |
| 6,490,962 | B1 | | 12/2002 | Schultz | |
| 6,990,888 | B2 | | 1/2006 | Harwarth | |
| 7,686,596 | B2 | | 3/2010 | Clausen | |
| 2005/0005672 | A1 | | 1/2005 | Sneath | |

FOREIGN PATENT DOCUMENTS

| | | |
|---|---|---|
| JP | 2008113513 | 5/2008 |

* cited by examiner

*Primary Examiner* — David B Jones
(74) *Attorney, Agent, or Firm* — Michael Best & Friedrich, LLP

(57) ABSTRACT

A high pressure tool assembly includes a hand control valve mechanically connectable to a tool. An intensifier is fluidly connected to the hand control valve and to the tool. The intensifier increases pressure of an operating fluid to be supplied to the tool. A first fluid circuit conveying the first operating fluid is formed between the intensifier and the tool. A second fluid circuit conveying a second operating fluid is formed between the hand control valve and the intensifier. The first fluid circuit operates at a first pressure. The second fluid circuit operates at a second pressure. The first pressure is higher than the second pressure. The first fluid circuit is isolated from the second fluid circuit.

20 Claims, 10 Drawing Sheets

BUCKET TRUCK INTENSIFIER

CROSS REFERENCE TO RELATED APPLICATION

This application claims the benefit under 35 U.S.C. §119 (e) of U.S. Provisional Application Ser. No. 61/663,825, filed Jun. 25, 2012, which is hereby incorporated by reference in its entirety. This application contains subject matter related to co-pending U.S. patent application Ser. No.(to be assigned), entitled "Bucket Truck Intensifier Having A Hydraulic Manifold," filed Jun. 24, 2013.

FIELD OF THE INVENTION

The present invention relates to a lightweight, high pressure tool assembly. More particularly, the present invention relates to a high pressure tool assembly operable from a bucket truck. Still more particularly, the present invention relates to a high pressure tool assembly including an intensifier for increasing pressure of an operating fluid and a hand control valve connected to a tool for controlling operation thereof.

BACKGROUND OF THE INVENTION

There is a growing demand for lighter weight, ergonomic utility tools, such as crimping and cutting tools, to reduce operator injury. Of particular interest is the need for lighter weight tools that are used by utility workers. Much of the work performed by utility workers is performed while standing within the bucket of a bucket truck. The nature of the work often requires the workers to hold a crimp tool in position on an electrical connector with their arms extended. The utility tools are generally heavy and awkward to operate. With rising concerns regarding preventing personal injury while operating such equipment, ergonomics are an important consideration. The weight of the utility tool becomes critical, as does the crimp cycle times.

Crimping and cutting tool designs vary in size, weight and configuration. Although most utility tools are high pressure (10,000 psi), low pressure (1500-3000 psi) utility tools are also used when working from the bucket of the bucket truck.

Low pressure crimp tools can be heavy and very unbalanced. However, in most cases, low pressure crimp tools crimp quickly. These low pressure crimp tools are typically powered by a hydraulic pump source, such as directly from the bucket truck. Low pressure operated crimp tools traditionally incorporate a large piston that is subjected to 1500-3000 psi operating pressure. The disadvantage of these tools is that they are heavy, big and not well balanced. From an ergonomic point of view, they score very low.

High pressure crimp tools are relatively light weight and ergonomic, however, they crimp slowly. These tools may also require gripping in an area of high pressure, which can be dangerous if there is a failure.

High pressure crimp tools are usually operated with an intensifier or a booster pump, which is powered by a bucket truck circuit. The booster or intensifier operates on low pressure and increases or intensifies the output to the 10,000 psi operating pressure requirement for high pressure tools. The booster pump may incorporate a hydraulic motor, such as gerotor or gear motor type, which can drive a high pressure pump to deliver 10,000 psi oil to a remote crimp head via a hydraulic hose. These units tend to be very slow during the high pressure delivery cycle as a result of low volumetric flow rates. There are also intensifiers that have reciprocating pistons that incorporate shuttle spools to sequence the pistons. These units are slow and have many moving parts.

Accordingly, a need exists for an improved high pressure tool that is easily handled and operates quickly.

SUMMARY OF THE INVENTION

Accordingly, it is a primary objective of the present invention to provide a high pressure tool that is lightweight and easy to operate.

A further objective of the present invention is to provide a high pressure tool that operates quickly.

Another objective of the present invention is to provide an improved intensifier for a high pressure tool.

The foregoing objectives are basically attained by a high pressure tool assembly including a hand control valve mechanically connectable to a tool. An intensifier is fluidly connected to the hand control valve and to the tool. The intensifier increases pressure of an operating fluid to be supplied to the tool. A first fluid circuit conveying the first operating fluid is formed between the intensifier and the tool. A second fluid circuit conveying a second operating fluid is formed between the hand control valve and the intensifier. The first fluid circuit operates at a first pressure. The second fluid circuit operates at a second pressure. The first pressure is higher than the second pressure. The first fluid circuit is isolated from the second fluid circuit.

Other objects, advantages and salient features of the invention will become apparent from the following detailed description, which, taken in conjunction with the annexed drawings, discloses exemplary embodiments of the present invention.

As used in this application, the terms "front," "rear," "upper," "lower," "upwardly," "downwardly," and other orientational descriptors are intended to facilitate the description of the exemplary embodiment of the present invention, and are not intended to limit the structure thereof to any particular position or orientation.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF EXEMPLARY EMBODIMENT

The exemplary embodiment of the present invention provides a quick-operating and lightweight tool that is easily handled and operated. The following description is directed to a high pressure crimping tool, although the present invention is equally applicable to any high pressure tool, such as a cutting tool.

Figure 1:
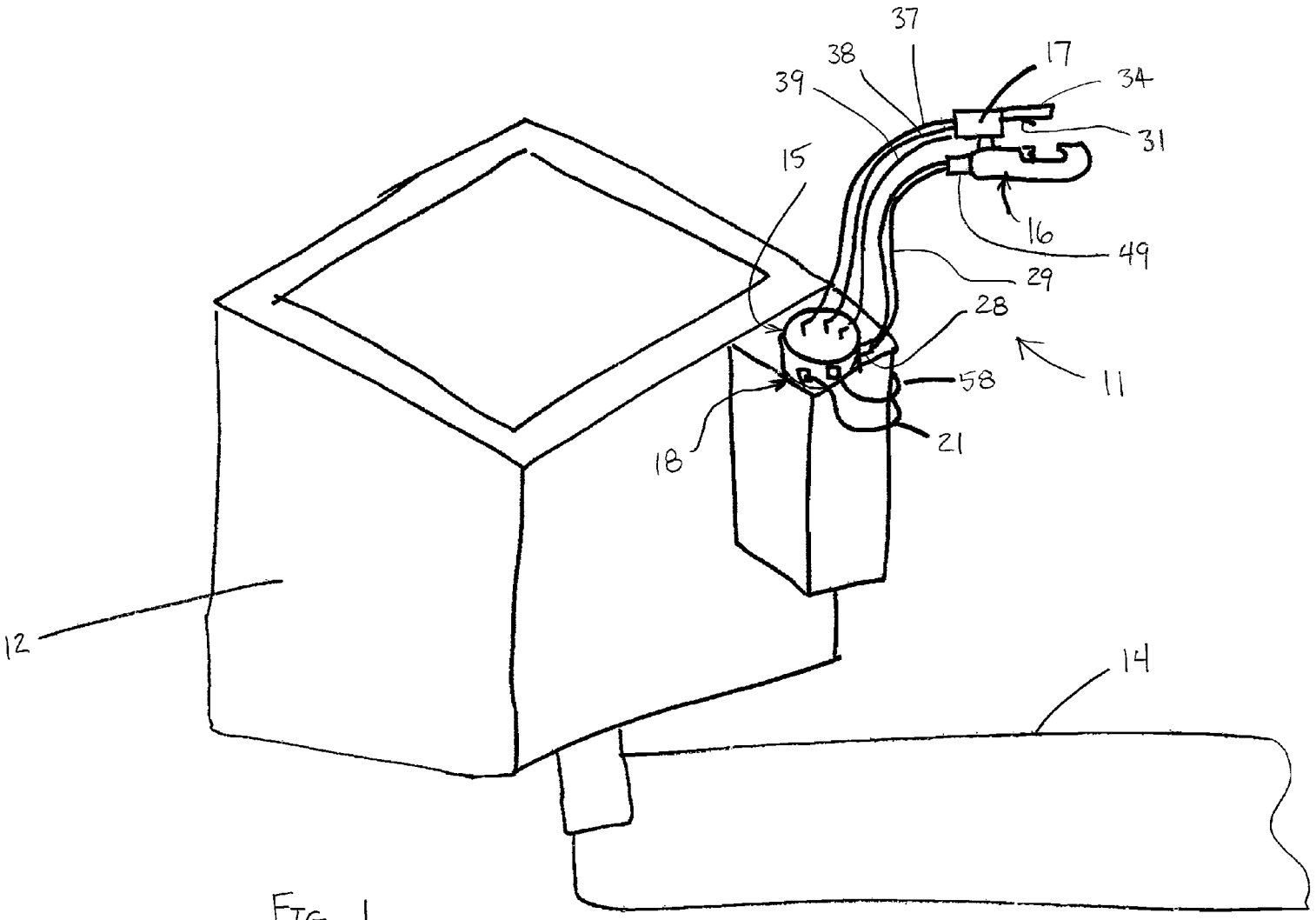
FIG. 1 is a perspective view of a bucket truck assembly according to an exemplary embodiment of the present invention.
Figure 11:
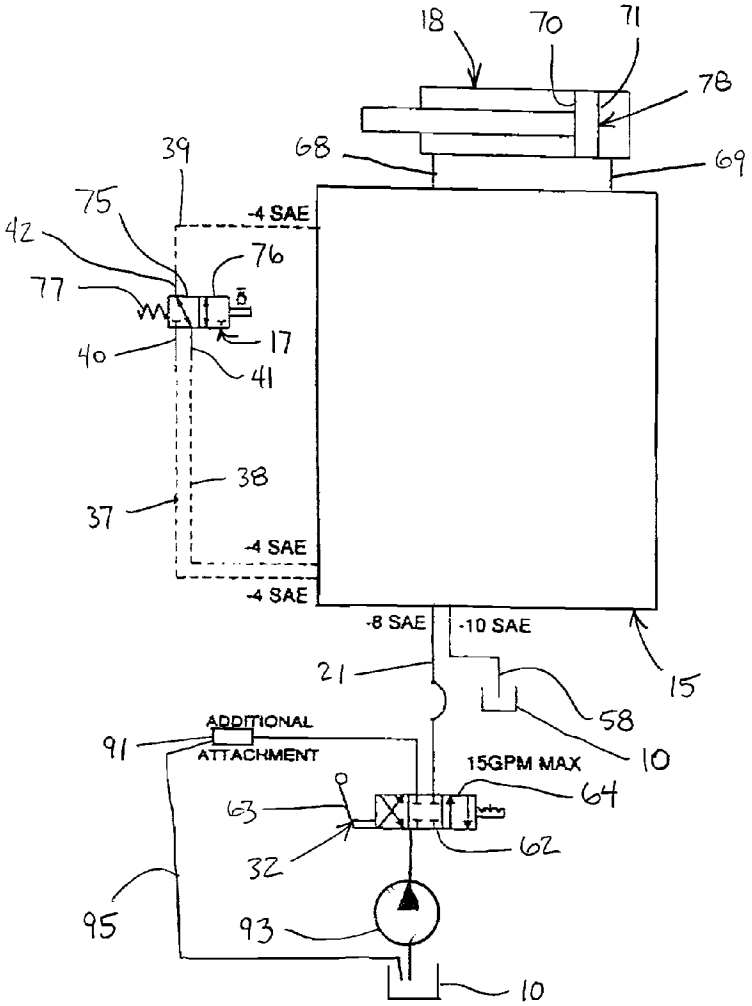
FIG. 11 is a schematic diagram of the hydraulic circuit of FIG. 8 with an additional tool connected thereto.
Figure 10:
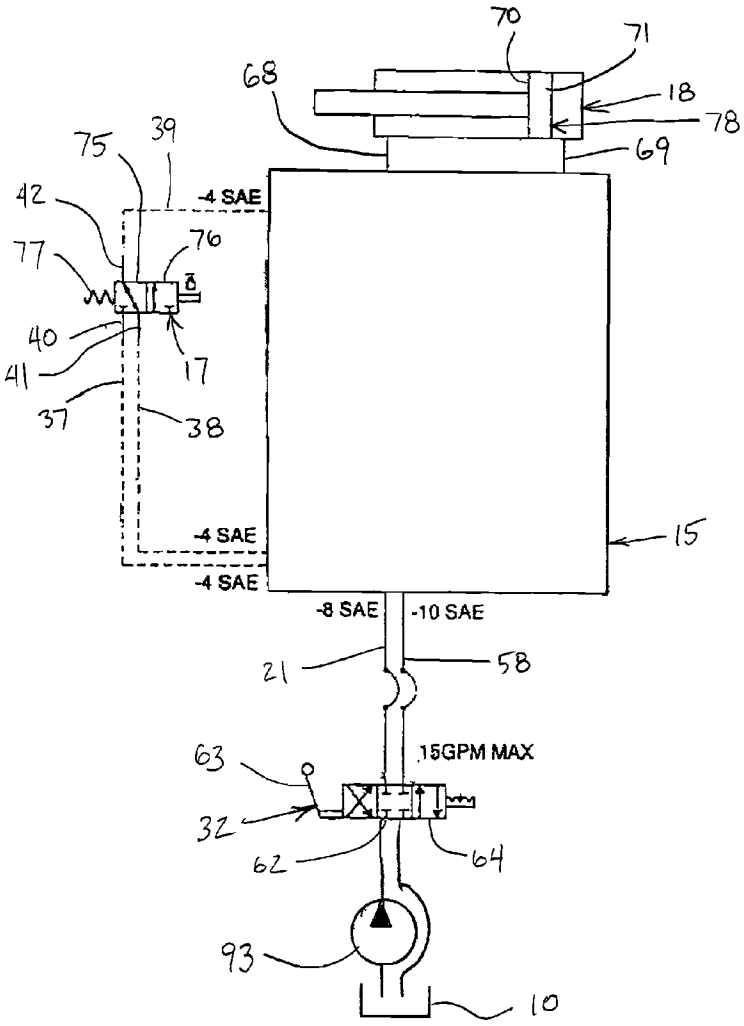
FIG. 10 is a schematic diagram of a hydraulic circuit.

The exemplary embodiment of the present invention includes a bucket truck tool assembly 11 operable by a user from a bucket truck 12, as shown in FIG. 1. A boom 14 connects the bucket 12 to a truck. The boom 14 is extendable to lift a utility worker in the bucket 12 to a position to perform the necessary work. A bucket truck valve 32, as shown in FIGS. 10 and 11, is connected to the bucket truck 12 (FIG. 1) to control the supply of operating fluid from a truck reservoir 10 on the truck to the components of the bucket truck tool assembly 11. Preferably, the operating fluid is hydraulic oil, although any suitable operating fluid can be used.

Figure 2:
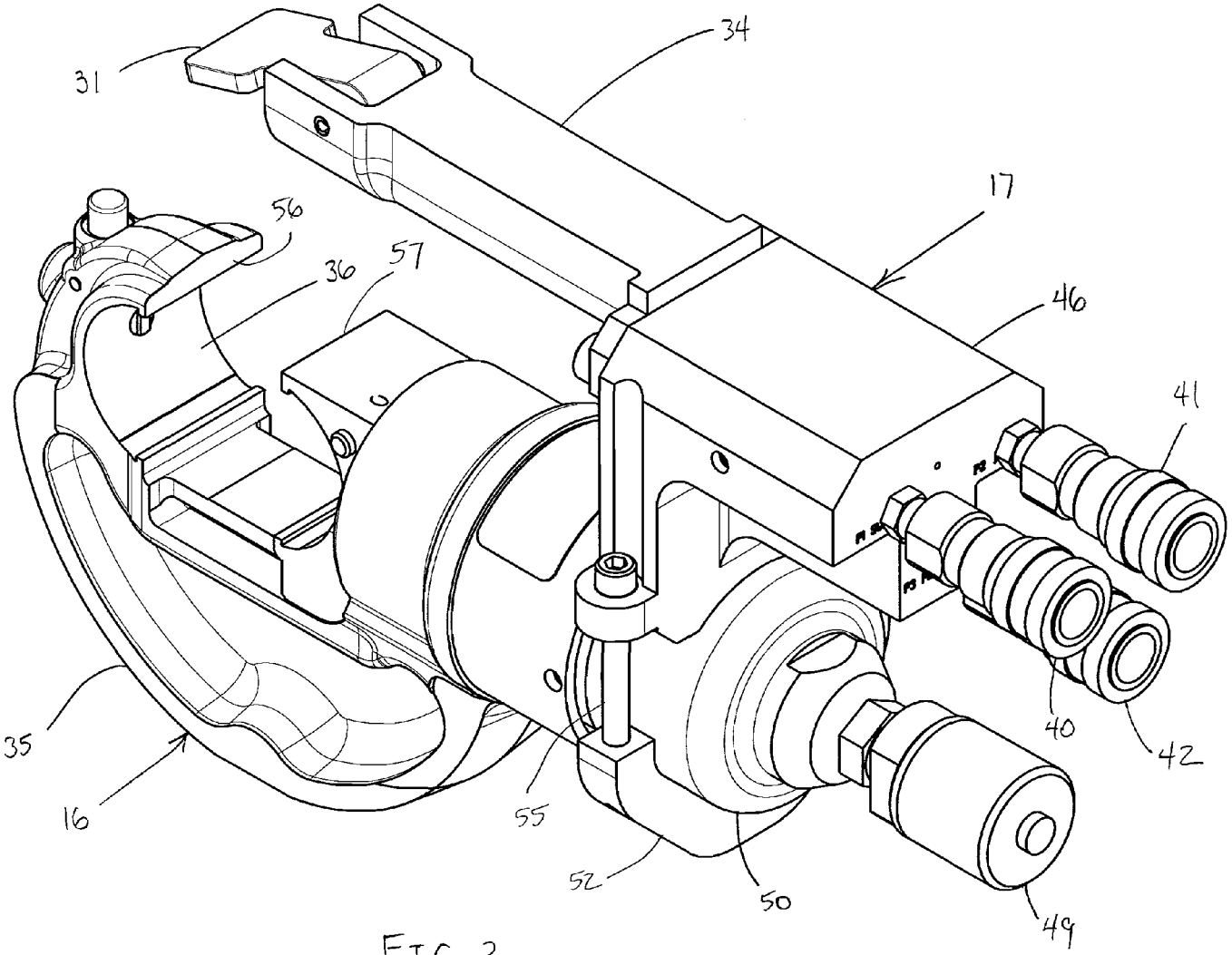
FIG. 2 is a perspective view of a tool and hand control valve of FIG. 1.
Figure 3:
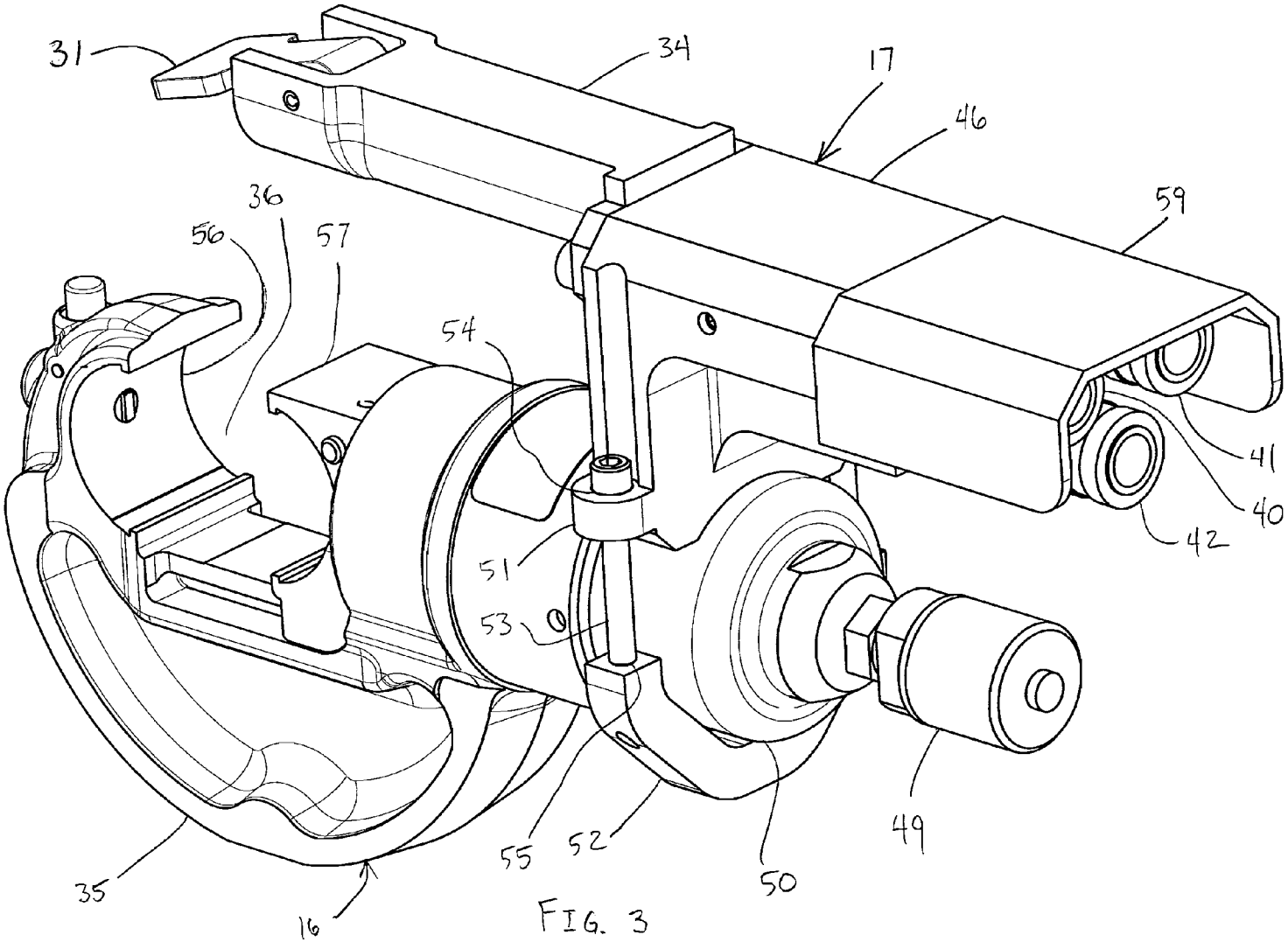
FIG. 3 is a perspective view of a guard connected to the hand control valve of FIG. 2.

The bucket truck tool assembly 11 includes a hand control valve 17, an intensifier 18 and a hydraulic manifold 15 for operating a high pressure crimping tool 16, as shown in FIGS. 1-11. The intensifier 18 intensifies or increases the pressure of the operating fluid supplied to the tool 16 to the required high pressure. The remote crimping tool 16 is lightweight and operates at high pressure, such as approximately 10,000 psi. The hand control valve 17 is mounted directly to the remote crimping tool 16. The hand control valve 17 is positioned to enable the operator to have a handle 34 or gripping region proximal the center of gravity of the remote crimping tool 16, as shown in FIGS. 2 and 3. The hand control valve handle 34 is disposed opposite the tool head 35. The work area 36 is disposed between the handle control valve handle 34 and the tool head 35. The hand control valve 17 is lightweight, preferably about approximately three pounds. The hand control valve 17 is preferably operated at a low pressure, such as approximately 1500 psi. Accordingly, the user does not need to handle the tool 16 to which the high pressure oil is supplied. The user can support and operate the tool 16 through the hand control valve 17, thereby substantially preventing injury associate with operating high pressure tools.

The intensifier 18 and the tool 16 are fluidly connected, as shown in FIGS. 1, 10 and 11. A first fluid circuit is formed between the intensifier 18 and the tool 16 to allow a first operating fluid to be conveyed therebetween at a first pressure. Preferably, the first pressure is a high pressure, such as approximately 10,000 psi. A second fluid circuit is formed between the hand control valve 17, the hydraulic manifold 15 and the intensifier 18, as shown in FIGS. 10 and 11. The hand control valve 17, the hydraulic manifold 15 and the intensifier 18 are fluidly connected to allow for a second operating fluid to be conveyed therebetween. Preferably, the second pressure is a low pressure, such as approximately 1500 psi. Preferably, the first and second fluid circuits are hydraulic circuits. The first fluid circuit is isolated from the second fluid circuit.

A plurality of pilot lines 37, 38 and 39 are connected to the hand control valve 17, as shown in FIGS. 1, 10 and 11. First, second and third pilot connections 40, 41 and 42 are connected to a housing 46 of the pilot control valve 17, as shown in FIGS. 2 and 3, receive the first, second and third pilot hoses 37, 38 and 39, respectively. First, second and third pilot openings 43, 44 and 45 in the housing 46, as shown in FIGS. 4-7, allow for the passage of operating fluid, such as hydraulic oil, in and out of hand control valve 17. The pilot lines 37, 38 and 39 extend between the hand control valve 17 and the hydraulic manifold 15, as shown in FIGS. 1, 10 and 11, to control operation of the tool 16. A trigger 31 is connected to the handle 34 of the hand control valve 17 to control operation thereof.

Figure 8:
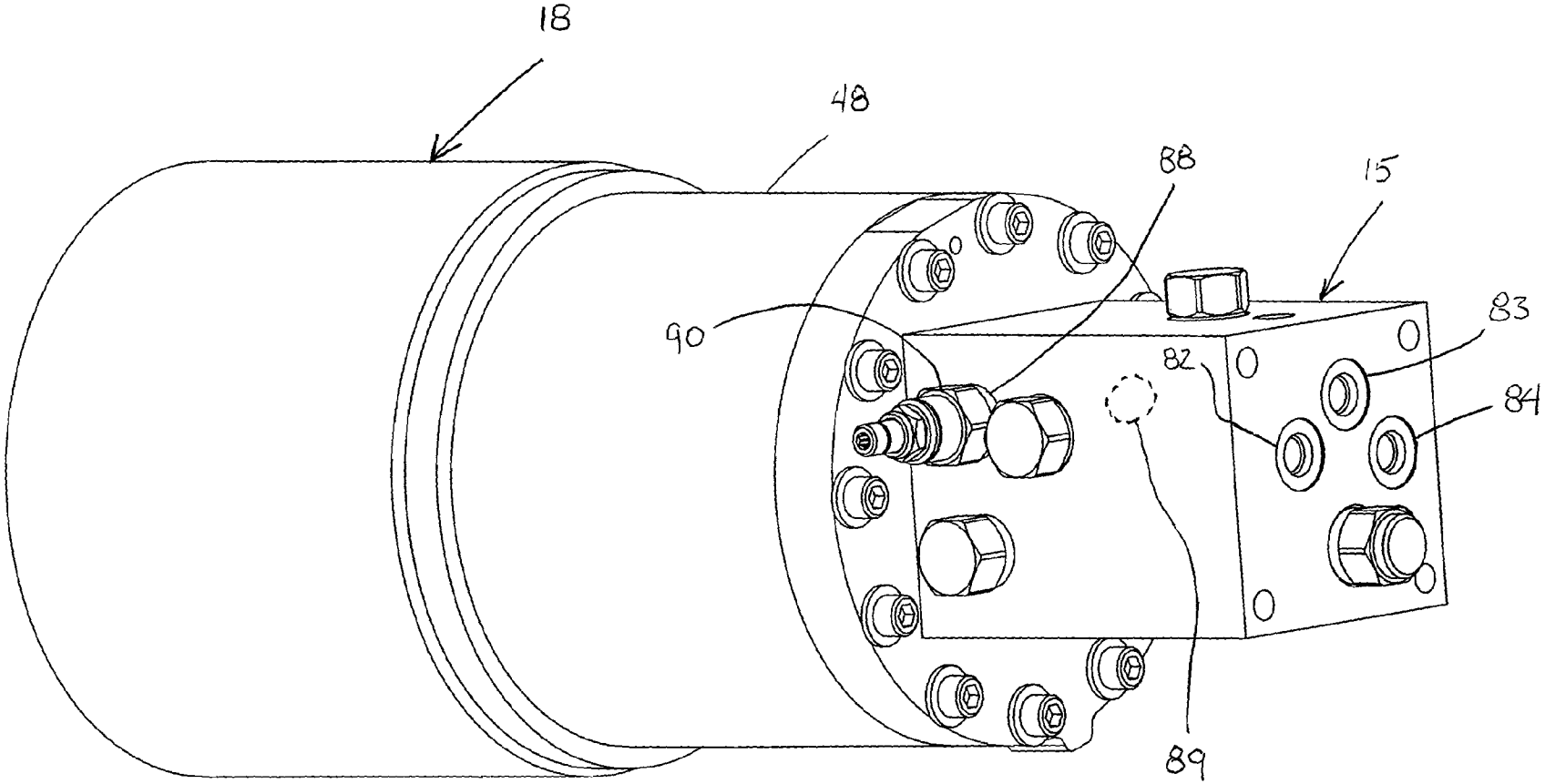
FIG. 8 is a side perspective view of the intensifier of FIG. 1.

Operating fluid, such as hydraulic oil, is supplied between the intensifier 18 and an oil reservoir 10 on the truck, as shown in FIGS. 1, 10 and 11. A supply hose 21 supplies oil from a truck pump 93 to the intensifier 18. A return hose 58 returns oil from the intensifier 18 to the oil reservoir 10 in the truck. The supply hose 21 is connected to a connector 90 in the hydraulic manifold 15, as shown in FIG. 8, to supply operating fluid through the inlet connection 88 in the hydraulic manifold 15 to the intensifier 18 through the bucket truck valve 32 and hydraulic manifold 15, as shown in FIGS. 10 and 11. The return hose 58 is connected to an outlet connection 89 in the hydraulic manifold 15, as shown in FIG. 8, to return operating fluid from the intensifier 18 to the truck reservoir 10, as shown in FIGS. 10 and 11. The outlet connection 89 is preferably disposed on the opposite side of the hydraulic manifold 15 as the inlet connection 88, as shown in FIG. 8.

A guard 59 is connected to the hand control valve housing 46, as shown in FIG. 3, to substantially cover the pilot line connections 40, 41 and 42 to substantially prevent injury to the user in the event of a leak or accidental line disconnect.

Figure 9:
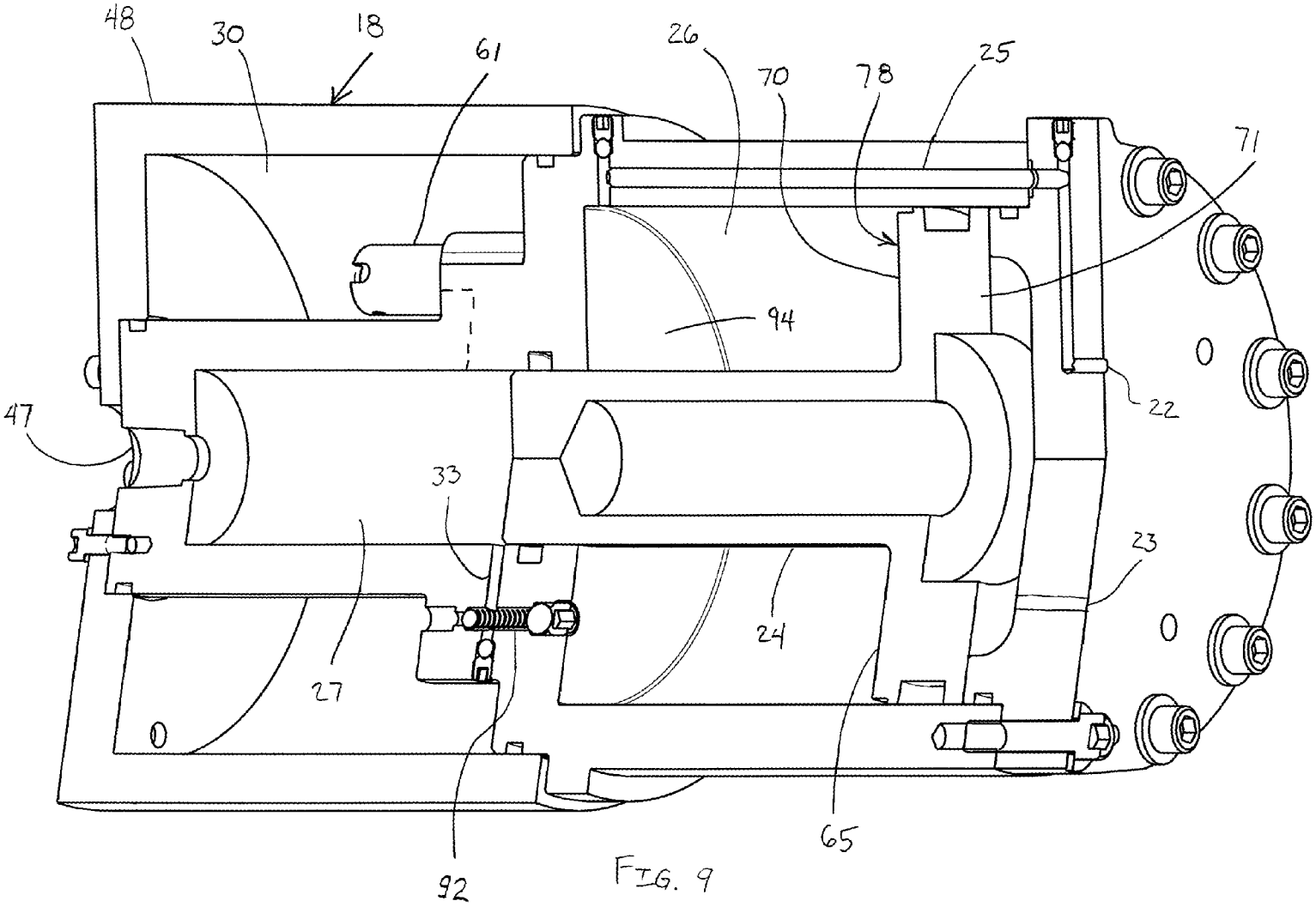
FIG. 9 is a side perspective view in cross-section of the intensifier of FIG. 8.

The intensifier 18, as shown in FIG. 1, has a connection 28 to which a high pressure hose 29 is connected. The high pressure connection 28 is in fluid communication with an opening 47 in a housing 48 of the intensifier 18, as shown in FIG. 9. Operating fluid, such as hydraulic oil, is supplied at a high pressure from a high pressure chamber 27 through the hose 29 to a connection 49 on a tool body 50, as shown in FIG. 1.

Figure 5:
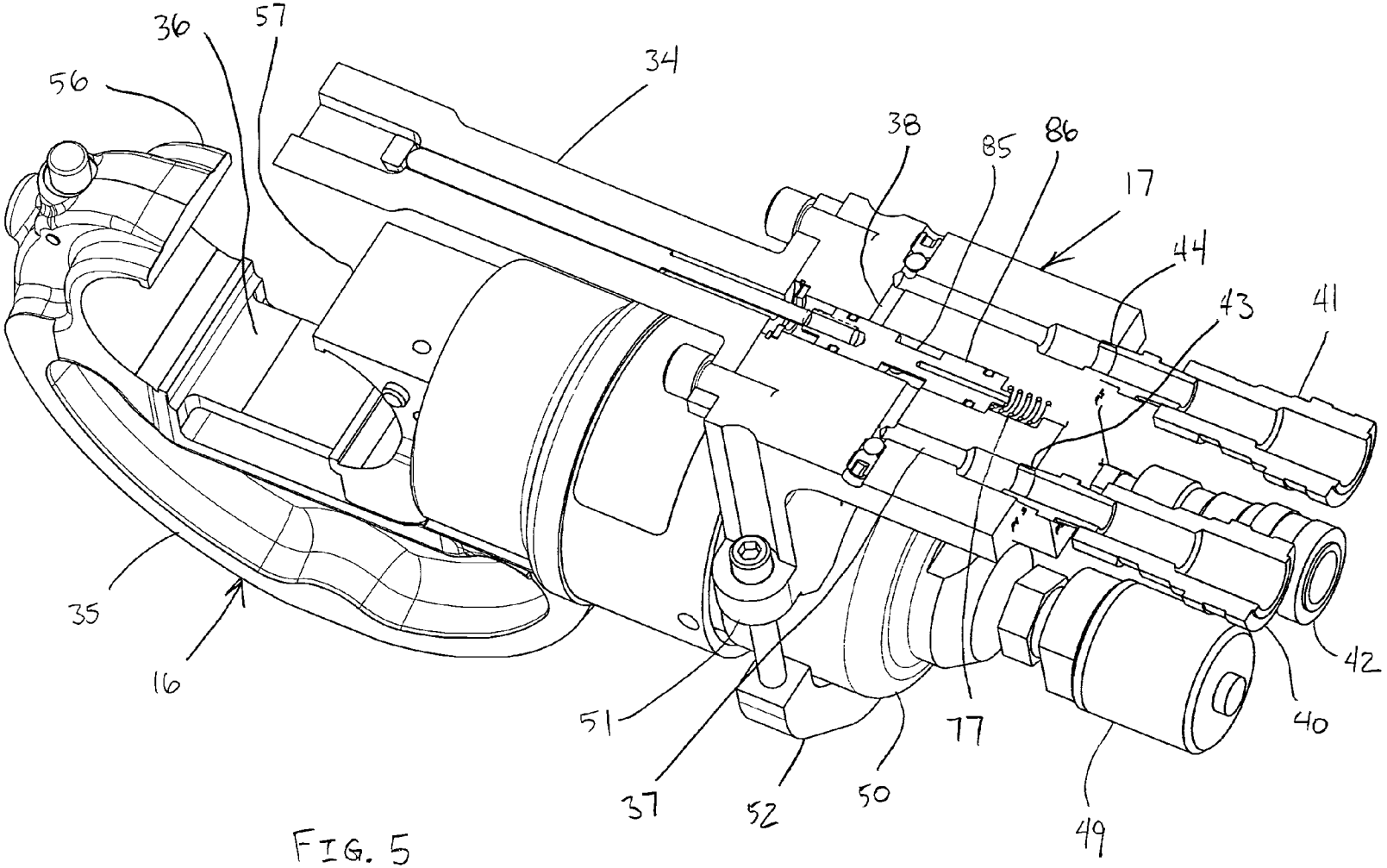
FIG. 5 is an upper perspective view in partial cross section of the hand control valve of FIG. 4 in the second position.

Mounting tabs 51 extend outwardly from opposite sides of the hand control valve housing 46, as shown in FIGS. 3 and 5. A jaw member 52 is connected to the tool body 50. Fasteners 53 are inserted through openings 54 in the mounting tabs 51 and are received by openings 55 in the jaw member 52, thereby securing the hand control valve 17 to the tool 16. The fasteners 53 can be removed from the mounting tabs 51 of the hand control valve housing 46 such that the hand control valve 17 can be easily removed from the tool 16. The hand control valve 17 can then be connected to another tool.

The crimping tool 16 has a fixed crimping member 56 and a movable crimping member 57, as shown in FIG. 3. The movable crimping member 57 is driven through the work area 36 to crimp an object disposed in the work area. The movable crimping member 57 is moved through the work area 36 by a ram (not shown) driven by high pressure operating fluid, such as hydraulic oil, supplied through the connection 49 from the intensifier 18.

When the trigger 31 of the hand control valve 17 is actuated, a pilot signal (preferably, hydraulic) is sent to the hydraulic manifold 15 through the third pilot line 39, as shown in FIGS. 10 and 11. This pilot signal directs the hydraulic manifold 15 to supply hydraulic oil from the intensifier 18 to the remote crimping tool 16 through the high pressure hose 29 to drive the movable crimping member 57 to perform a crimping operation. The hydraulic oil is supplied to the intensifier 18 through supply hose 21 to drive the ram in a first direction to perform the crimp.

Releasing the trigger 31 of the hand control valve 17 stops the supply of operating fluid from the first pilot line 37 because the first pilot line 37 is no longer connected to the third pilot line 39 when the trigger 31 is released, such that the third pilot line 39 does not send operating fluid to the hydraulic manifold 15. The hydraulic manifold 15 directs the ram of the crimping tool 16 to return to a home position in preparation for the next crimp cycle in response to the signal from the hand control valve 17. The ram is driven in the second direction by supplying oil to a first connection 68 of the intensifier 18 to retract a piston assembly 78 therein, thereby discharging the hydraulic oil from the intensifier 18 through a second connection 69 to a return line 58.

The intensifier 18 is directed by the hydraulic manifold 15 to perform the desired function, i.e., crimping or retracting the ram to the home position. The hydraulic manifold 15 is directed by the hand control valve 17 to cause the intensifier 18 to provide the operating fluid pressure for the tool 16 to perform the function (crimping or retracting) selected by the user.

The intensifier 18 increases or intensifies the pressure of the hydraulic oil to be supplied to the tool 16. The hydraulic oil is supplied from the intensifier 18 to the tool 16, such as a crimping or cutting tool. The hand control valve 17 is preferably directly mechanically connected to the tool 16 to control operation of the hydraulic oil supplied to the tool 16.

The intensifier 18 uses low pressure hydraulic oil supplied at approximately 1500 psi and intensifies the pressure to 10,000 psi, thereby obtaining an intensification ratio of approximately six. The low pressure oil is supplied through a supply line 21 from the truck pump 93 to the intensifier 18. The piston assembly 78 movably disposed in the intensifier 18 is preferably unitarily formed as a single member.

Operation and Assembly

The bucket truck valve 32, as shown in FIGS. 10 and 11 is shown in a closed position 62. The activating lever 63 moves the bucket truck valve 32 between closed and open positions 62 and 64. In the closed position 62, the bucket truck valve 32 is closed to prevent the supply of hydraulic oil to the components. In the open position 64, the bucket truck valve 32 supplies oil through supply line 21 to the hydraulic manifold 15 and the hand control valve 17. Hydraulic oil can also be returned to the truck reservoir 10 from the return line 58 through the bucket truck valve 32. The bucket truck valve 32 is typically kept in the open position 64 when the utility worker is in the bucket truck 12 to facilitate operating the tool 16. The bucket truck valve 32 preferably has a maximum flow rate of approximately 15 gallons per minute (gpm).

When the bucket truck valve 32 is in the first or open position 64, hydraulic oil is supplied to the hydraulic manifold 15 and to the hand control valve 17 through the first pilot line 37. First and second lines 68 and 69 are connected between the hydraulic manifold 15 and the intensifier 18. Hydraulic oil can be supplied through the first line 68 to the rod side of first side 70 of the piston flange 65 of the piston assembly 78 in the intensifier 18 from the hydraulic manifold 15. The supplied hydraulic oil pushes against a first surface 70 of the piston assembly 78, thereby moving the piston assembly to the home position (to the right in FIGS. 10 and 11). The hydraulic oil on a second side 71 of the piston assembly 78 is returned through the second line 69, through the hydraulic manifold 15, and through the return line 58 to the truck reservoir 10.

Figure 6:
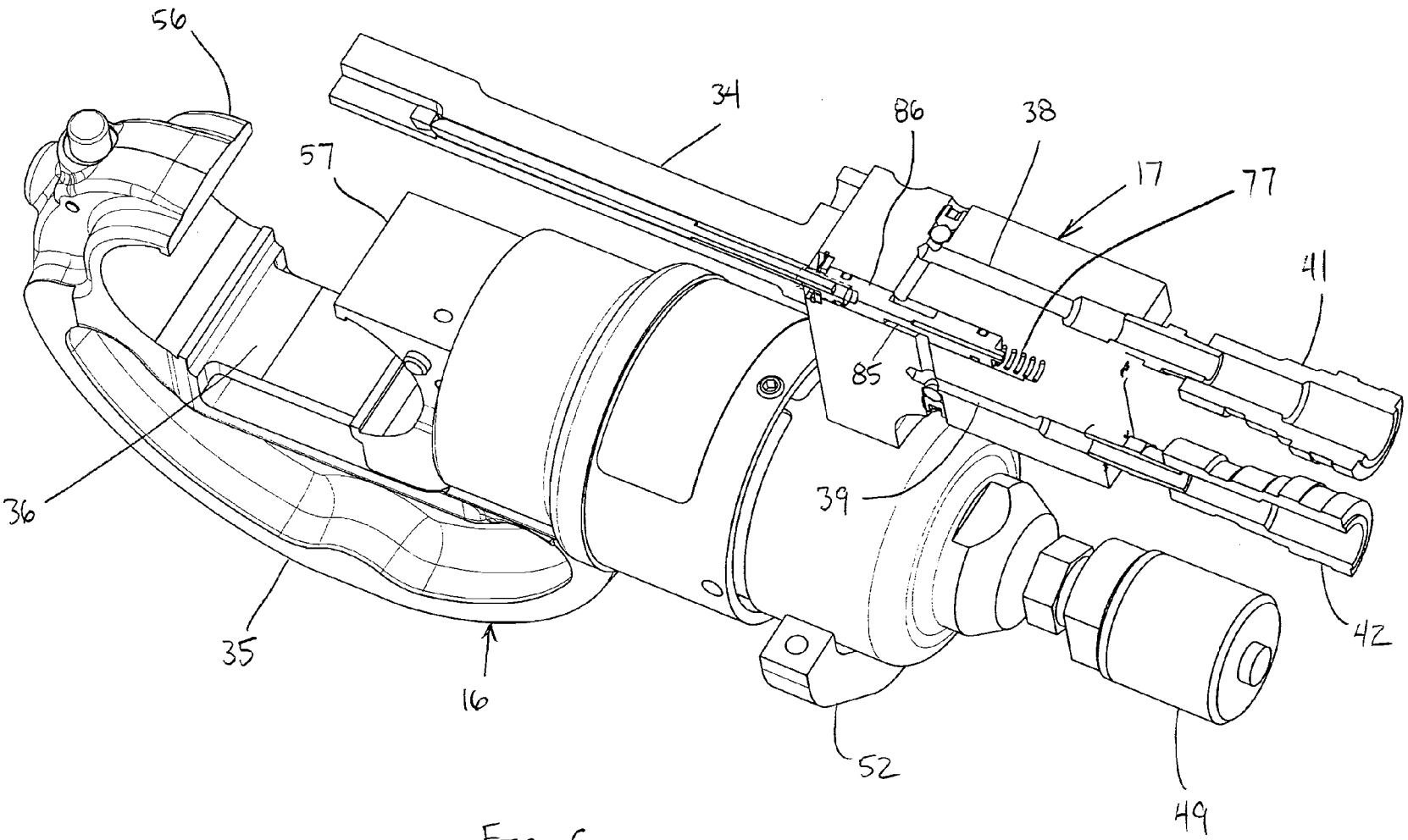
FIG. 6 is a side perspective view in partial cross-section of the hand control valve of FIG. 2 in a first position in which second and third pilot lines are connected.
Figure 7:
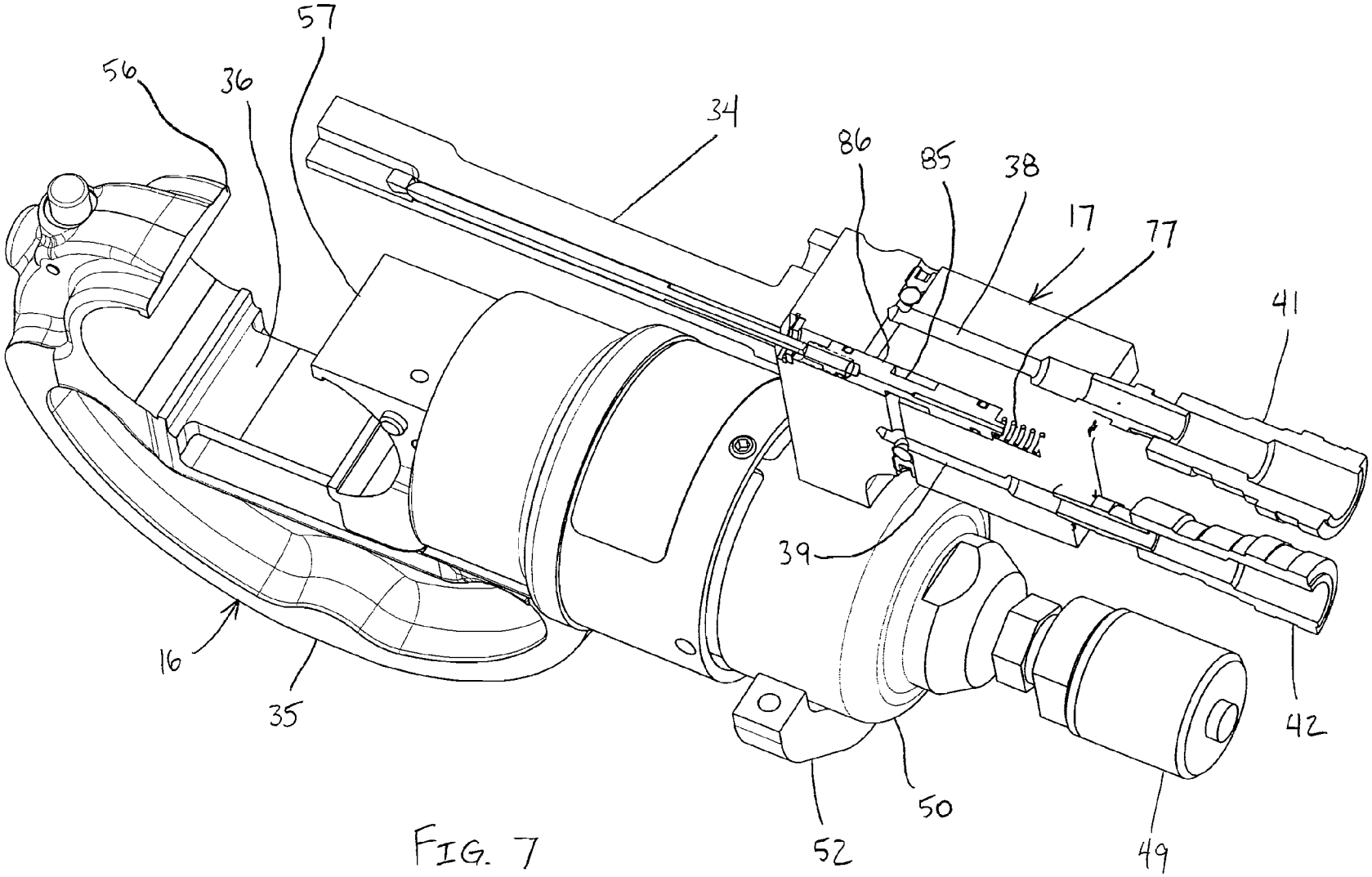
FIG. 7 is a side perspective view in partial cross-section of the hand-control valve of FIG. 2 in the second position in which first and third pilot lines are connected.

Hydraulic oil is supplied to the hand control valve 17 through the first pilot line 37, as shown in FIGS. 10 and 11. The hand control valve 17 is movable between first and second positions 75 and 76, and is shown in the first position 75 in FIGS. 10 and 11. In the first position 75, the second and third pilot lines 38 and 39 are fluidly connected, as shown in FIG. 6, such that hydraulic oil from the supply line 21 through the first pilot line 37 is not supplied to the hydraulic manifold 15. Preferably, a spring member 77 biases the hand control valve 17 to the first position 75. Activating the trigger 31 of the hand control valve 17 overcomes the spring bias of the spring member 77 and moves the hand control valve 17 to the second position 76, such that the first and third pilot lines 37 and 39 are in fluid communication. The second and third pilot lines 38 and 39 are not connected when the hand control valve 17 is in the second position 76, as shown in FIG. 7. Hydraulic fluid is supplied from the supply line 21, through the first pilot line 37, through the third pilot line 39 to the hydraulic manifold 15 to such that hydraulic oil from the supply line 21 is now supplied through the second line 69 from the hydraulic manifold 15 to the second side 71 of the piston flange 65 of the intensifier 18. The piston assembly 78 is moved through the intensifier to increase or intensify the pressure of the hydraulic oil to approximately 10,000 psi.

First, second and third ports 82, 83 and 84 in the hydraulic manifold 15 receive the first, second and third pilot connections 40, 41 and 42, respectively. As shown in FIGS, 6, 10 and 11, the hand control valve 17 is spring-biased to the first position 75 such that the second and third pilot lines 38 and 39 are in fluid communication. A port 85 in a valve member 86 connects the second and third pilot lines 38 and 39. Accordingly, operating fluid is not supplied to the hydraulic manifold 15 such that the oil from the supply line 21 is supplied to the first line 68 because the first pilot line 37 is not connected to the third pilot line 39. Accordingly, the piston assembly 78 is in the home position.

Figure 4:
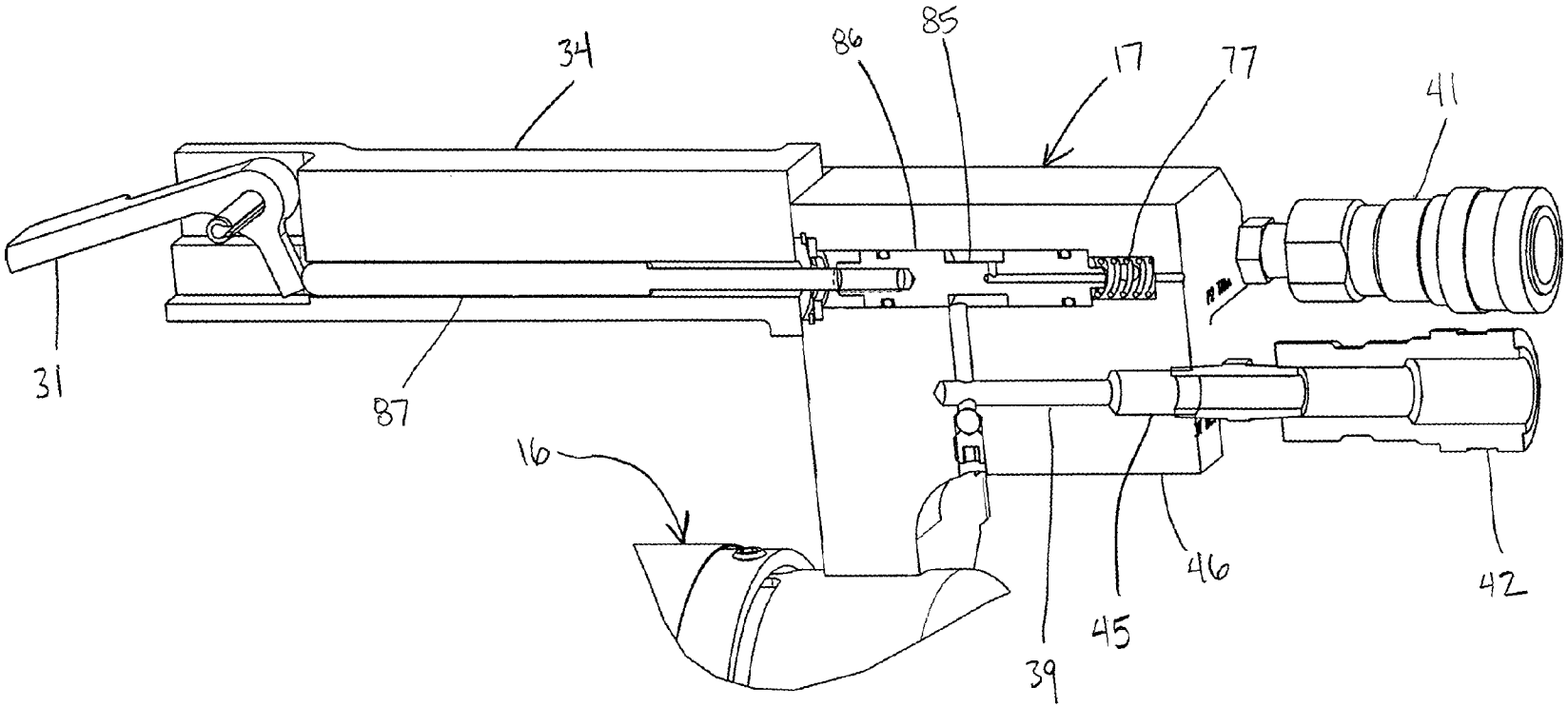
FIG. 4 is a side perspective view in partial cross-section of the hand control valve of FIG. 2 in a second position in which first and third pilot lines are connected.

Activating the trigger 31 of the hand control valve 17 moves the valve member 86 to overcome the spring bias of the spring member 77, such that the port 85 connects the first and third pilot lines 37 and 39, as shown in FIGS. 4, 5 and 7. A rod 87 extends between the trigger 31 and the valve member 86 to move the valve member responsive to activating the trigger 31. Operating fluid from the truck pump 93 can be supplied from the supply line 21, through the first pilot line 37 and through the third pilot line 39 to the hydraulic manifold 15, and then to the second line 69 of the intensifier 18. The second and third pilot lines 38 and 39 are not connected when the trigger 31 of the hand control valve 17 is operated. Releasing the trigger 31 causes the spring member 77 to move the valve member 86 to the first position 75 (FIGS. 10 and 11) in which the second and third pilot lines 38 and 39 are connected.

To achieve intensification, hydraulic oil is supplied to the second side 71 of the large diameter (e.g., 5.68 inch diameter), low pressure flange 65 of the piston assembly 78 disposed in the intensifier 18 through an inlet port 23, as shown in FIG. 9. The hydraulic oil is supplied through the supply line 21 to the hydraulic manifold 15, which supplies the oil to the supply oil inlet 23 of the intensifier 18. The high pressure piston rod 24 is of a smaller diameter (e.g., 2.00 inch diameter). The high pressure piston rod 24 is sized to allow approximately 300 psi back pressure on the first side 70 of the large piston flange 65. There is also hydraulic oil in a cylinder 26 of the intensifier 18. Movement of the piston assembly 78 through the intensifier 18 during a crimping procedure pushes the oil on the first side 70 of the piston flange 65 out through conduit 25, through outlet 22, through the first line 68, through the hydraulic manifold 15 and back to the truck reservoir 10 through the return line 58.

To perform the crimping cycle, the user activates the trigger 31 of the hand control valve 17. Hydraulic oil is directed to the hydraulic manifold 15, which redirects oil to the large diameter piston 65 of the intensifier, which starts the crimp cycle, as shown in FIGS. 1 and 9. Hydraulic oil at 1500 psi acts on the second side 71 of the piston flange 65 and applies a high force onto the small diameter piston rod 24. The small diameter piston rod 24 then compresses the hydraulic oil in the small cylinder 27 to approximately 10,000 psi. The intensified high pressure oil is forced out of the intensifier 18 through a high pressure hose 29 having a connection 49 connected to a high pressure outlet 47, which is connected to the remote crimp tool 16. The remote crimp tool 16 is designed to make a good crimp at 10,000 psi operating pressure. When the recommended pressure of 10,000 psi is reached, a pressure relief valve 61 opens to relieve the pressure back to an intensifier reservoir 30, as shown in FIG. 9. The intensifier reservoir 30 is preferably made of a flexible material.

The intensifier reservoir 30 is isolated from the truck reservoir 10 in the truck. The crimp cycle is complete when the pressure relief valve 61 opens. When the pressure relief valve 61 opens, an audible pop is detected, and the 10,000 psi hose 29 connected coupled to the remote crimp tool 16 flexes as pressure is quickly released. The audible pop of the pressure relieve valve 61 and the flex of the hydraulic hose 29 are indications to the operator that the crimp cycle is complete. Additionally, the large piston 65 in the intensifier 18 bottoms against a lower surface 94 of the cylinder 26 and the thump noise is heard.

As a result, the operator releases the activate trigger 31 on the hand control valve 17 and oil is no longer directed to the hydraulic manifold 15 from the hand control valve, thereby redirecting oil to the rod side on the first side 70 of the piston flange 65 from the supply line 21. The spring member 77 moves the hand control valve 17 to the first position 75, such that the first and second pilot lines 37 and 39 are no longer connected. The hydraulic manifold 15 directs the hydraulic oil from the supply line 21 through the first line 68 to the connection port 22 in the intensifier and through conduit 25 to the low pressure cylinder 26 on the first side 70 of the piston flange 65. Accordingly, the piston assembly 78 retracts to the home position, as shown in FIG. 9. During this retraction phase, oil is pulled in through a check valve 92 allowing the high pressure cylinder 27 to reload oil from the intensifier reservoir 30 through a conduit 33 in preparation for the next crimp cycle.

The intensifier 18 is powered by a bucket truck circuit 32 and provides intensified oil that is directed through the high pressure hydraulic hose 29 to the crimping tool 16. Intensification of the oil is performed with a single stroke motion of the piston assembly 78 within the intensifier 18. The oil delivery to the crimping tool 16 is pressure limited to approximately 10,000 psi by the pressure relief valve 61 within the intensifier 18. This intensifier system performs a full crimp in approximately two seconds because it displaces a large amount of hydraulic oil in a single stroke motion. The intensifier 18 also has few moving parts, thereby simplifying assembly and operation thereof. The pressure relief valve 61 within the high pressure cylinder 27 of the intensifier 18 opens to relieve pressure when a predetermined pressure value (10,000 psi) is reached for a good crimp.

When the pressure relief valve 61 opens, a large amount of oil from the high pressure cylinder 27 and the tool 16 is relieved into the intensifier's reservoir 30. The high pressure relief valve 61 stays open until the piston flange 65 reaches the bottom of its stroke. At an end of the stroke, the relief valve 61 closes. When the user releases the hand control valve lever 31, the intensifier 18 enters retraction mode. As the piston rod 24 retracts, a check valve 32 within the high pressure cylinder 27 is forced open, allowing the high pressure cylinder 27 to fill with oil from the intensifier reservoir 30. Thus, the hydraulic oil in the intensifier reservoir 30 and the tool 16 is isolated from the truck oil and is therefore less susceptible to contamination.

The intensifier 18 is operator controlled by the low pressure hand control valve 17, which is held in the palm of the user's hand and allows activation with the push of the lever 31 and retraction with the release of the lever 31. The hand control valve 17 provides the handle 34 that shifts the center of gravity of the crimping tool 16 and hand control valve 17 to a more ergonomic position, thereby reducing operator strain. There are no high pressure components held in the user's hand. The hand control valve 17 is modular and can be removed by the user for crimp and cut tool swap out. The protective shield 59 (FIG. 3) covers the low pressure hydraulic couplings (40, 41 and 42) to protect them from damage.

Although described with regard to the crimping tool 16, the present invention is also applicable to other hydraulically operated tools, such as a cutting tool. As shown in FIG. 11, an additional tool 91 can be connected to the bucket truck valve 32 to be operated thereby. Preferably, a three position bucket truck valve 32 is used, as shown in FIG. 11. A return line 95 from the additional tool 91 can be directed to the truck reservoir 10.

The foregoing embodiment and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. A high pressure tool assembly, comprising:

a tool;

a hand control valve mechanically connectable to the tool;

a first operating fluid to be supplied to the tool;

an intensifier fluidly connected to said hand control valve and to the tool, said intensifier increasing a pressure of the first operating fluid to be supplied to the tool;

a second operating fluid to be supplied to said intensifier;

a first fluid circuit formed between said intensifier and the tool, said first fluid circuit conveying the first operating fluid at a first pressure; and a second fluid circuit formed between said hand control valve and said intensifier, said second fluid circuit conveying the second operating fluid at a second pressure, said first pressure being higher than said second pressure, and said first fluid circuit being isolated from said second fluid circuit.

2. The high pressure tool assembly according to claim 1, wherein said hand control valve is removably connectable to the tool.

3. The high pressure tool assembly according to claim 1, wherein said hand control valve further comprises a handle, wherein said handle of said hand control valve is disposed proximal the center of gravity of the tool to facilitate handling the tool with said handle of said hand control valve.

4. The high pressure tool assembly according to claim 1, wherein said hand control valve moves between a first position in which said intensifier moves to a crimping position and a second position in which said intensifier returns to a home position.

5. The high pressure tool assembly according to claim 4, wherein said hand control valve further comprises a valve member, wherein said valve member in said hand control valve is moved between first and second positions to move said hand control valve between said first and second positions.

6. The high pressure tool assembly according to claim 5, further comprising a spring member, wherein said spring member biases said hand control valve to said second position.

7. The high pressure tool assembly according to claim 6, further comprising an activating trigger, wherein said activating trigger is connected to said valve member to move said valve member from said second position to said first position.

8. The high pressure tool assembly according to claim 7, further comprising a first opening in said intensifier, wherein the second operating fluid is directed to said first opening in said intensifier when said hand control valve is in said second position to move a piston assembly in said intensifier to said home position.

9. The high pressure tool assembly according to claim 8, wherein the second operating fluid is directed to said first opening in said intensifier when said hand control valve is in said first position to move said piston assembly in said intensifier to said crimping position.

10. The high pressure tool assembly according to claim 1, further comprising a pressure relief valve, wherein said pressure relief valve in said intensifier opens at a predetermined pressure to stop the supply of the first operating fluid to the tool.

11. The high pressure tool assembly according to claim 10, wherein said pressure relief valve opens at approximately 10,000 psi.

12. The high pressure tool assembly according to claim 1, wherein an audible or tactile indication is generated by said intensifier when the supply of the first operating fluid to the tool is stopped.

13. The high pressure tool assembly according to claim 1, further comprising:

a first cylinder and a second cylinder;

wherein said intensifier has said first cylinder in fluid communication with said first fluid circuit and said second cylinder in fluid communication with said second fluid circuit.

14. The high pressure tool assembly according to claim 13, further comprising an intensifier reservoir, wherein said intensifier reservoir supplies the first operating fluid to said first cylinder.

15. The high pressure tool assembly according to claim 14, further comprising a check valve, wherein said check valve controls the supply of the first operating fluid from said intensifier reservoir to said first cylinder.

16. The high pressure tool assembly according to claim 14, further comprising a pressure relief valve, wherein said pressure relief valve opens to direct the first operating fluid from said first cylinder to said intensifier reservoir when a predetermined operating pressure is reached.

17. The high pressure tool assembly according to claim 14, wherein the second operating fluid is supplied to said second cylinder in response to operation of said hand control valve.

18. The high pressure tool assembly according to claim 17, further comprising a piston assembly having a first side having a first inlet, said piston assembly having a home position, wherein the second operating fluid is supplied to said first inlet on said first side of said piston assembly in said second cylinder to move said piston assembly to said home position.

19. The high pressure tool assembly according to claim 18, wherein said piston assembly further comprises a second side having a second inlet, said piston assembly having a crimping position, wherein the second operating fluid is supplied to said second inlet on said second side of said piston assembly in said second cylinder to move said piston assembly to said crimping position.

20. The high pressure tool assembly according to claim 1, wherein said intensifier is remote from said hand control valve.

* * * * *